US011619355B2

(12) United States Patent
Choi

(10) Patent No.: US 11,619,355 B2
(45) Date of Patent: Apr. 4, 2023

(54) METHOD FOR AUTOMATICALLY REPLACING HIGH-PRESSURE GAS BARRELS

(71) Applicant: AMT CO., LTD., Asan-si (KR)

(72) Inventor: Won Ho Choi, Cheonan-si (KR)

(73) Assignee: AMT CO., LTD., Asan-si (KR)

( * ) Notice: Subject to any disclaimer, the term of this patent is extended or adjusted under 35 U.S.C. 154(b) by 491 days.

(21) Appl. No.: 16/771,079

(22) PCT Filed: Dec. 19, 2018

(86) PCT No.: PCT/KR2018/016222
§ 371 (c)(1),
(2) Date: Jun. 9, 2020

(87) PCT Pub. No.: WO2019/124966
PCT Pub. Date: Jun. 27, 2019

(65) Prior Publication Data

US 2021/0190269 A1 Jun. 24, 2021

(30) Foreign Application Priority Data

Dec. 19, 2017 (KR) ..... 10-2017-0174740
Dec. 19, 2018 (KR) ..... 10-2018-0164682

(51) Int. Cl.
*F17C 13/04* (2006.01)
*F17C 13/08* (2006.01)

(52) U.S. Cl.
CPC ..... *F17C 13/045* (2013.01); *F17C 13/084* (2013.01); *F17C 2205/013* (2013.01); *F17C 2205/0111* (2013.01); *F17C 2227/042* (2013.01); *F17C 2250/03* (2013.01); *F17C 2270/0518* (2013.01)

(58) Field of Classification Search
CPC ..... F17C 13/084; F17C 2205/013; F17C 2223/0123; F17C 13/045; F17C 2227/042
See application file for complete search history.

(56) References Cited

U.S. PATENT DOCUMENTS

2009/0121592 A1* 5/2009 De Nando ..... A61B 50/10 312/209
2010/0051567 A1* 3/2010 Ross, Jr. ..... F17C 13/084 248/311.2
2013/0106073 A1* 5/2013 Gamard ..... B62B 3/104 280/79.2

FOREIGN PATENT DOCUMENTS

JP H07-190298 A 7/1995
JP 2960125 B2 10/1999
KR 10-0123200 B1 11/1997
(Continued)

OTHER PUBLICATIONS

International Search Report for PCT/KR2018/016222 dated Mar. 27, 2019 from Korean Intellectual Property Office.

*Primary Examiner* — Atif H Chaudry
(74) *Attorney, Agent, or Firm* — Paratus Law Group, PLLC

(57) ABSTRACT

Disclosed is a method for automatically replacing high-pressure gas barrels, in which when loading a high-pressure gas barrel is loaded on the lift of a cabinet so as to supply gas to the wafer production line in the semiconductor fabrication FAB process facility, at the time point of replacement of the high-pressure gas barrel, a used high-pressure gas barrel is separated from a connector holder and then a new high-pressure gas barrel is connected to the connector holder.

16 Claims, 10 Drawing Sheets

(56) References Cited

FOREIGN PATENT DOCUMENTS

| | | | |
|---|---|---|---|
| KR | 10-0242982 | B1 | 2/2000 |
| KR | 10-0649112 | B1 | 11/2006 |
| KR | 10-0846670 | B1 | 7/2008 |
| KR | 10-2010-0037674 | A | 4/2010 |
| KR | 10-0985575 | B1 | 10/2010 |

* cited by examiner

METHOD FOR AUTOMATICALLY REPLACING HIGH-PRESSURE GAS BARRELS

CROSS-REFERENCE TO PRIOR APPLICATIONS

This application is a National Stage Patent Application of PCT International Patent Application No. PCT/KR2018/016222 (filed on Dec. 19, 2018) under 35 U.S.C. § 371, which claims priority to Korean Patent Application Nos. 10-2017-0174740 (filed on Dec. 19, 2017) and 10-2018-0164682 (filed on Dec. 19, 2018), which are all hereby incorporated by reference in their entirety.

BACKGROUND

The present invention relates to a method for automatically replacing high-pressure gas barrels, in which when loading a high-pressure gas barrel is loaded on the lift of a cabinet so as to supply gas to the wafer production line in the semiconductor fabrication FAB process facility, at the time point of replacement of the high-pressure gas barrel, a used high-pressure gas barrel is separated from a connector holder and then a new high-pressure gas barrel is connected to the connector holder.

In general, various kinds of gas are supplied and used in a manufacturing process for manufacturing a semiconductor, and in the case where the gas is mostly sucked into the human body or exposed to the atmosphere, the gas mostly causes great damage such as safety accidents and environmental contamination and thus careful attention is required.

For example, as the type of gas used in the ion implantation process, there is fluent gas such as Arsine (AsH3), Phosphine (PH3), or Boron Fluoride (BF3), and the gas must be carefully managed so that the gas does not leak during the supply to the production line because the gas is highly toxic and results in fatal consequences when a worker inhales the same in the respiratory system.

The gas used in the semiconductor manufacturing process is very important in its management, wherein the gas is supplied to a production line through a gas supply line in a state, in which the gas is charged with high-pressure in a gas container (hereinafter, referred to as a "high-pressure gas barrel") and the gas barrel is installed in a cabinet, and if the gas is exhausted by about 90%, a worker continues to supply gas by replacing the high-pressure gas barrel with a new high-pressure gas barrel so that the foreign substances remaining inside the high-pressure gas barrel are not supplied to the wafer processing process.

FIG. 1 is a perspective view schematically showing a prior art gas supply device of semiconductor equipment, in which a cabinet 1 is positioned at a predetermined position outside an FAB 7 so as to install a plurality of high-pressure gas barrels (not shown) respectively filled with process gas such as SiH4, PH3, NF3, and CF4, which are required by various equipment 8 in the FAB helmet 7, and a duct 4 is installed at one side of the cabinet 1 so as to guide gas supply lines 3 connected to the high-pressure gas barrels, respectively.

In order to supply the process gas introduced along the gas supply lines 3, regulator boxes 5 are installed at the other side of the duct 4 as many as the number corresponding to the number of the high-pressure gas barrels, and supply pipes 9 are connected to the upper portion of each of the regulator boxes 5, wherein the number of the supply pipes 9 is equal to the number of the equipment 8 so that the supply pipes 9 can be connected correspondingly to each of the equipment 8 in the FAB 7.

Therefore, if the process gas is supplied from each of the high-pressure gas barrels secured in the cabinet 1, each process gas is introduced into each of the regulator boxes 5 along the gas supply lines 3 passing through the inside of the duct 4.

Thereafter, each process gas introduced into each of the regulator boxes 5 is purified through a filter (not illustrated) and then supplied flowing through each of the supply pipes 9, which are branched to a number corresponding to the equipment 8 in the FAB 7 and connected thereto, so that wafers can be processed.

As described above, if the gas is exhausted while being supplied through the gas supply lines 3 and the replacement time of the high-pressure gas barrel is detected by a control unit (not illustrated), a worker closes the valve of the used high-pressure gas barrel and separates the used high-pressure gas barrel from the external gas line.

Thereafter, the worker unloads the high-pressure gas barrel, which has been separated from the gas line, from the cabinet 1, replaces it with a new high-pressure gas barrel, connects the high-pressure gas barrel back to the external gas line, and opens the valve handle that closes the gas injection nozzle thereof, thereby completing the replacement of the high-pressure gas barrel.

PRIOR ART DOCUMENTS

[Patent Document 0001] Korean Reg. Patent Publication No. 10-0242982 (Reg. on 15 Nov. 1998)

[Patent Document 0002] Korean Reg. Patent Publication No. 10-0649112 (Reg. on 16 Nov. 2006)

[Patent Document 0003] Korean Reg. Patent Publication No. 10-0985575 (Reg. on 29 Sep. 2010)

SUMMARY

However, in the conventional high-pressure gas barrel replacement, when the replacement time of the high-pressure gas barrel is detected in a state where the worker has loaded a new high-pressure gas barrel into the cabinet, the worker has to manually separate and remove the used high-pressure gas barrel and then connect the new high-pressure gas barrel to the connector holder of the gas pipe. Therefore, it was impossible to carry out rapid replacement of high-pressure gas barrels and a human error is generated according to the skill of the worker, wherein when the gas leaks from the high-pressure gas barrel inadvertently due to carelessness during the replacement work, there was a fatal defect in which the gas exploded or the worker was poisoned by the leaked gas.

The present invention has been derived to solve these problems in the prior art and the purpose of the present invention is to realize automation in replacement of high-pressure gas barrels by enabling a high-pressure gas barrel connected to a connector holder to be separated therefrom simultaneously with automatically connecting a new high-pressure gas barrel to the connector holder by simply loading the high-pressure gas barrel on a lift installed in a cabinet at the time of replacement of the high-pressure gas barrel.

In order to achieve the purposes, according to one aspect of the present invention, there is provided a method for automatically replacing high-pressure gas barrels, comprising, in sequence, the first step of loading first and second high-pressure gas barrels on one pair of lifts, which are installed on a cabinet so as to be lifted or lowered, so as to supply the gas of the first high-pressure gas barrel through a gas supply line and connecting a valve connector of the second high-pressure gas barrel to a connector holder in a standby state, the second step of switching channels so as to stop gas supply from the first high-pressure gas barrel and supplying gas from the second high-pressure gas barrel, if the replacement time of the first high-pressure gas barrel is detected by a control unit while supplying gas from the first high-pressure gas barrel, the third step of automatically closing a valve handle of the first high-pressure gas barrel, the fourth step of releasing the connection state of the first high-pressure gas barrel from the connector holder and closing the valve connector by an end cap, the fifth step of lowering a die, on which the first high-pressure gas barrel is loaded, to the bottom dead point, the sixth step of automatically removing a gasket that has been used from the connector holder, the seventh step of releasing the clamping state of the first high-pressure gas barrel loaded on the die, the eighth step of opening the door of the cabinet and removing the first high-pressure gas barrel from the die, and then loading a third high-pressure gas barrel on the die and closing the door, the ninth step of clamping the third high-pressure gas barrel loaded on the die, the tenth step of automatically inserting a new gasket into the connector holder, the eleventh step of lifting the lift, on which the third high-pressure gas barrel is loaded, to the top dead point and then aligning the center of the valve connector and the center of the connector holder, the twelfth step of removing the end cap from the third high-pressure gas barrel and then connecting the valve connector to the connector holder, and the thirteenth step of opening the valve handle of the third high-pressure gas barrel in a standby state.

According to the present invention, one pair of lifts are installed in a cabinet so as to be lifted or lowered so that gas may be supplied from any one of high-pressure gas barrels through a gas supply line and, when the time of replacement of the high-pressure gas barrel is detected by a control unit, after channels are switched so that gas may be supplied from the other high-pressure gas barrel that is in a standby state, the high-pressure gas barrel from which gas supply is finished may be automatically unloaded from the die of the lift and a new high-pressure gas barrel may be loaded on the die of the lift so as to be maintained in a standby state. Therefore, according to the present invention, it is possible to automatically replace the high-pressure gas barrels differently from the prior art, in which high-pressure gas barrels are manually replaced, thereby preventing human errors caused by workers in advance and realizing automation in replacement of the high-pressure gas barrels.

DETAILED DESCRIPTION

Figure 1:
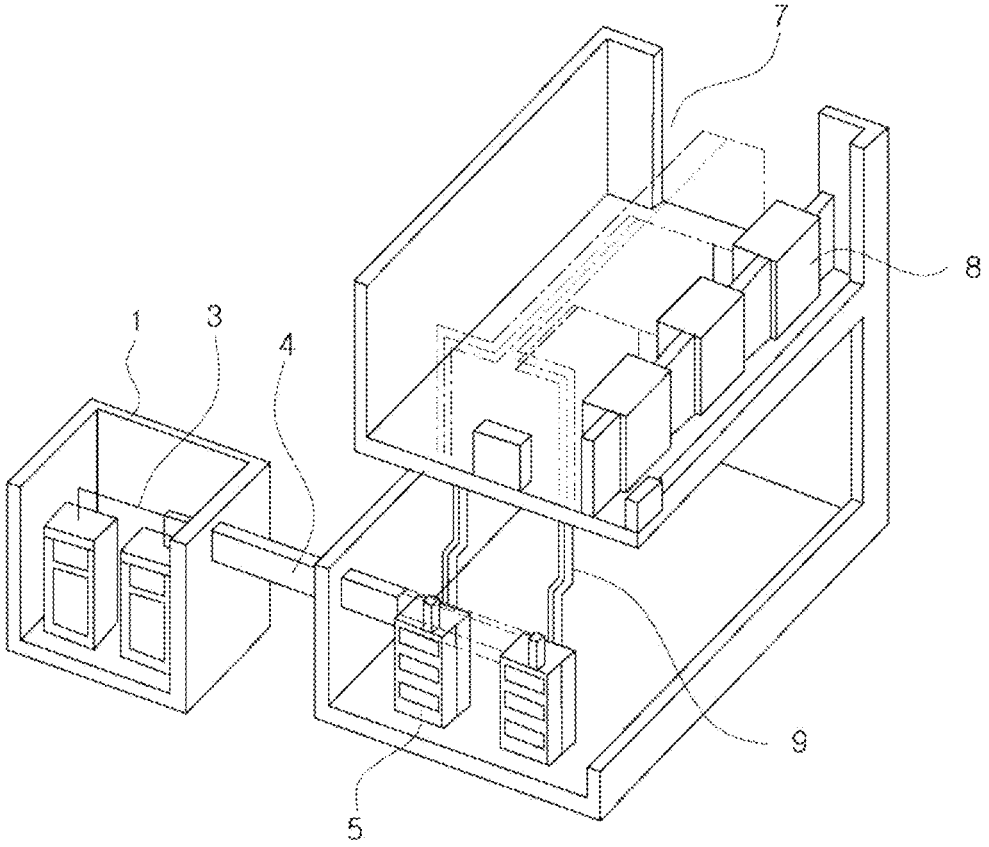
FIG. 1 is a perspective view schematically showing a prior art gas supply device of a semiconductor device.

Hereinafter, preferred embodiments of the present invention will be described in detail with reference to the accompanying drawings so that those skilled in the art to which the present invention belongs can easily practice. The present invention may be embodied in many different forms and should not be construed as limited to the embodiments set forth herein. It is to be noted that the drawings are schematic and not drawn to scale. The relative dimensions and proportions of the parts in the figures are shown to be exaggerated or reduced in size for clarity and convenience in the drawings and any dimensions are merely illustrative and not limiting. In addition, like structures, elements, or components appearing in two or more figures are used to indicate like features.

Figure 2:
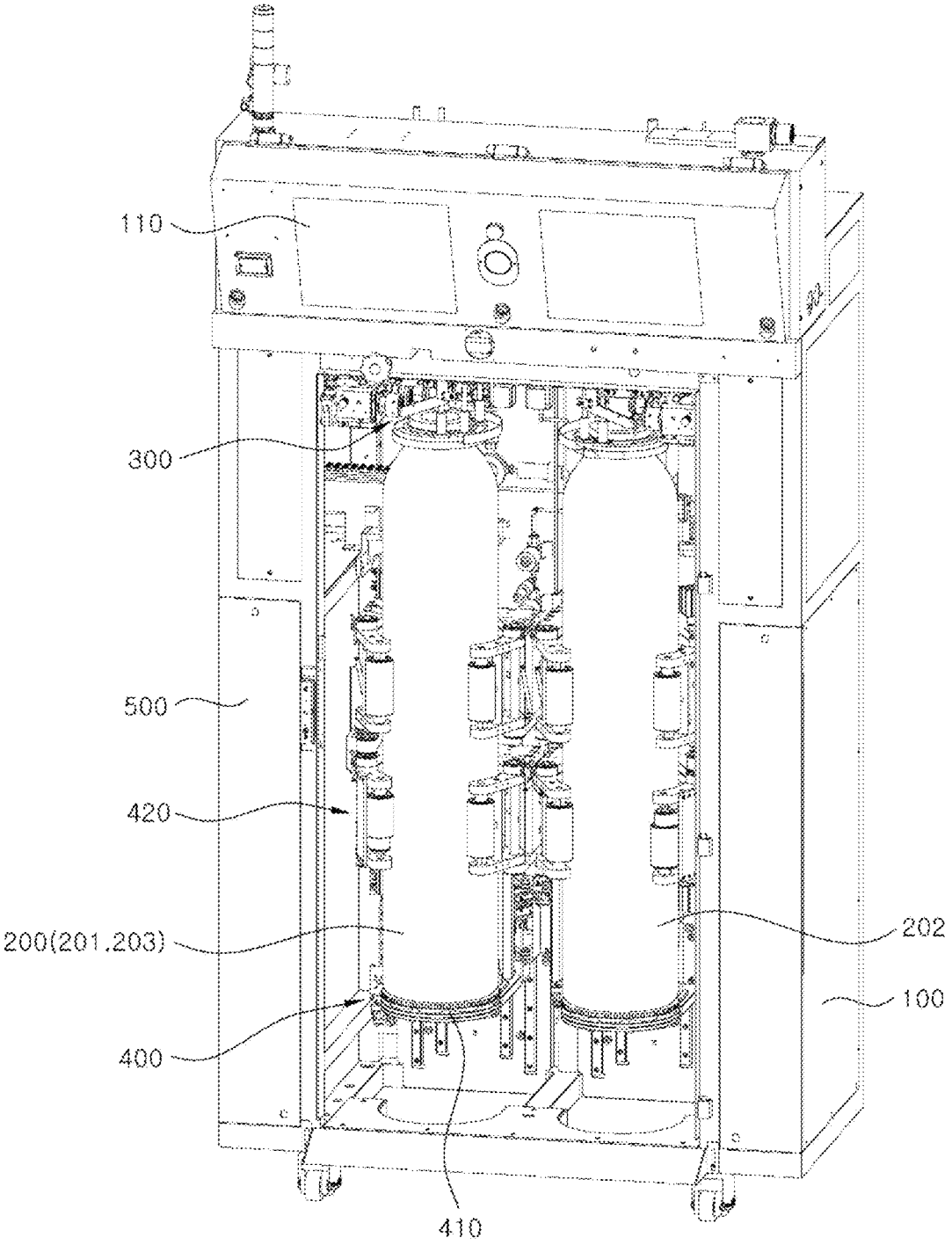
FIG. 2 is a front view of a cabinet for explaining the present invention.
Figure 3:
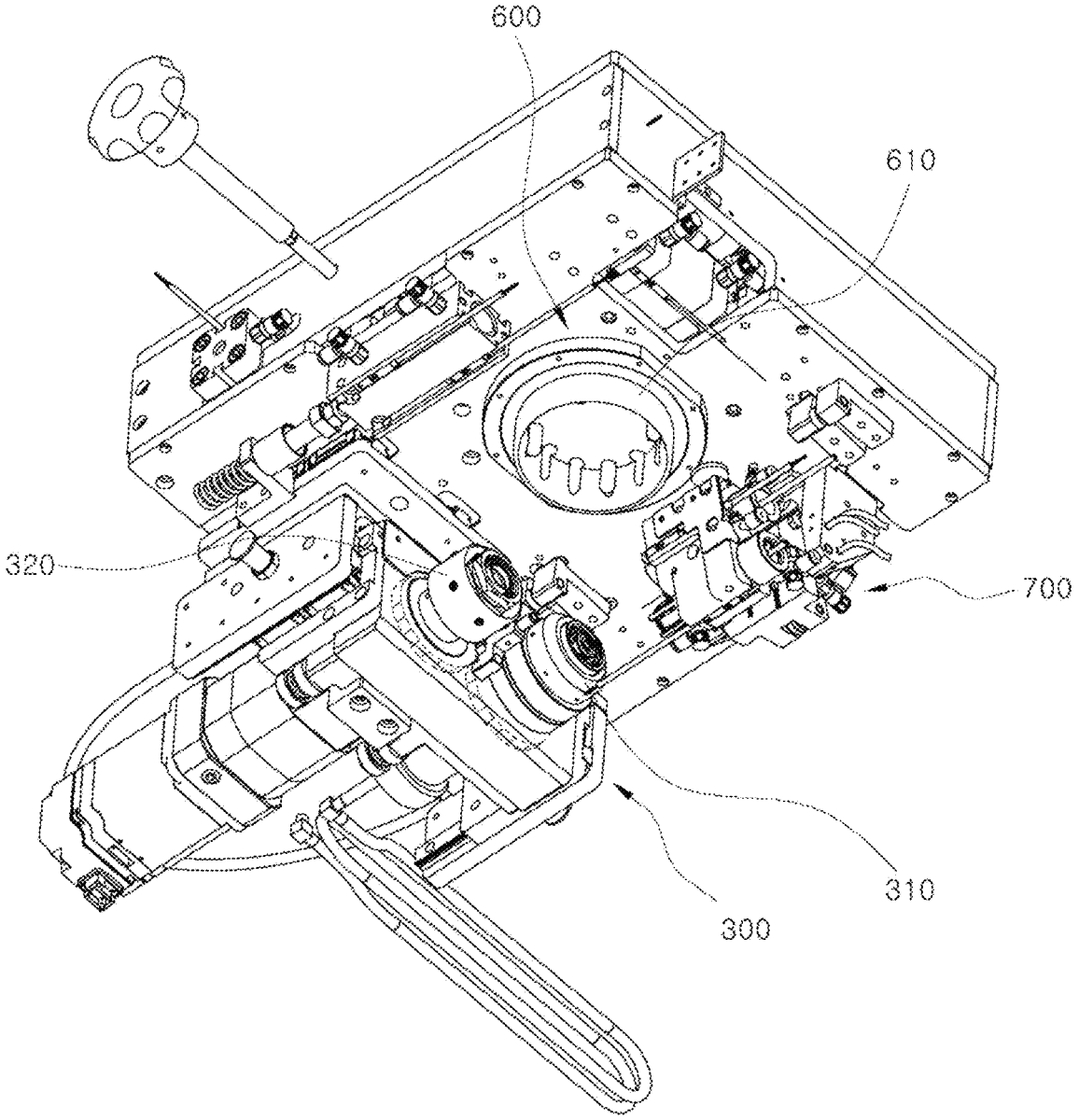
FIG. 3 is a perspective view showing a connection unit according to the present invention.
Figure 4A:
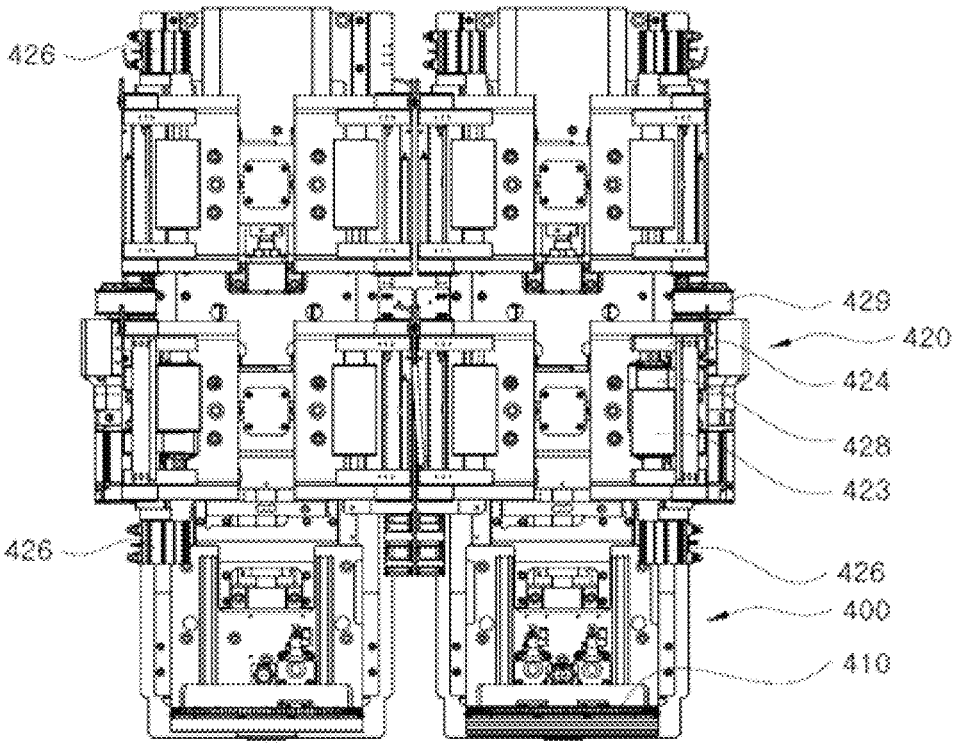
FIG. 4A is a front view showing a lift and a clamp according to the present invention.
Figure 4B:
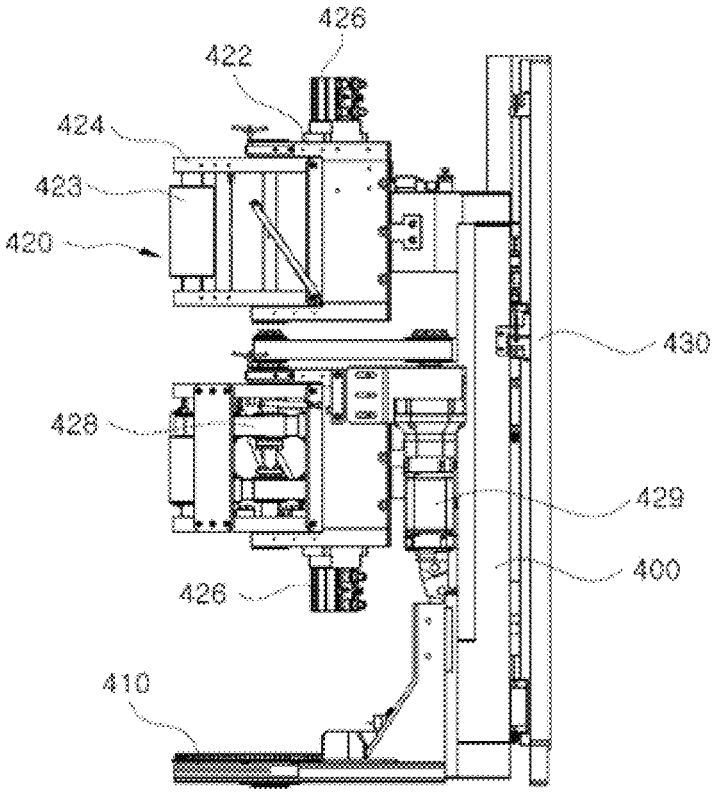
FIG. 4B is a right-side view showing the lift and the claim.

FIG. 2 is a front view of a cabinet for explaining the present invention, FIG. 3 is a perspective view showing a connection unit according to the present invention, and FIG. 4A is a front view showing a lift and a clamp according to the present invention and FIG. 4B is a right-side view of the lift and the clamp, wherein a door installed to be opened or closed on the front of a cabinet 100 is omitted in FIG. 2.

The present invention includes a connection unit 300 installed at the upper portion of a cabinet 100 inside the cabinet 100 so as to automatically connect or disconnect the valve connector 211 of a high-pressure gas barrel 200 to or from a connector holder 310, a lift 400 having a die 410, on which the high-pressure gas barrel 200 is loaded, so as to lift or lower the high-pressure gas barrel 200, a clamp 420 provided on the lift 400 so as to clamp and rotate the high-pressure gas barrel 200, and a control unit 500 for controlling the above constituent elements.

In the present invention, since two high-pressure gas barrels 200 are loaded in the cabinet 100, one pair of lifts 400 each having a connection unit 300 and a clamp 420 are installed, wherein when supplying gas from any one of the pressure gas barrels 200 through a gas supply line (not shown), any one high-pressure gas barrel 202 is connected to the connector holder 310 of another connection unit 300 so as to be maintained in a standby state for gas supply.

Since the two high-pressure gas barrels 200 are provided at the upper portion of the cabinet 100, the cabinet 100 includes screens 110, which are respectively positioned at the upper portions of the respective connection units 300 and allow a worker to open doors (not shown) of the cabinet 100, to control the clamping or unclamping of the high-pressure gas barrels 200, and to input information on the high-pressure gas barrels 200.

The clamps 420 are respectively installed at the upper and lower portions of the respective lift 400 that is installed on a moving base 430 so as to lift or lower, as shown in FIGS. 4A and 4B, and serve to clamp or unclamp the high-pressure gas barrel 200 loaded on the die 410 of the lift 400.

Figure 5:
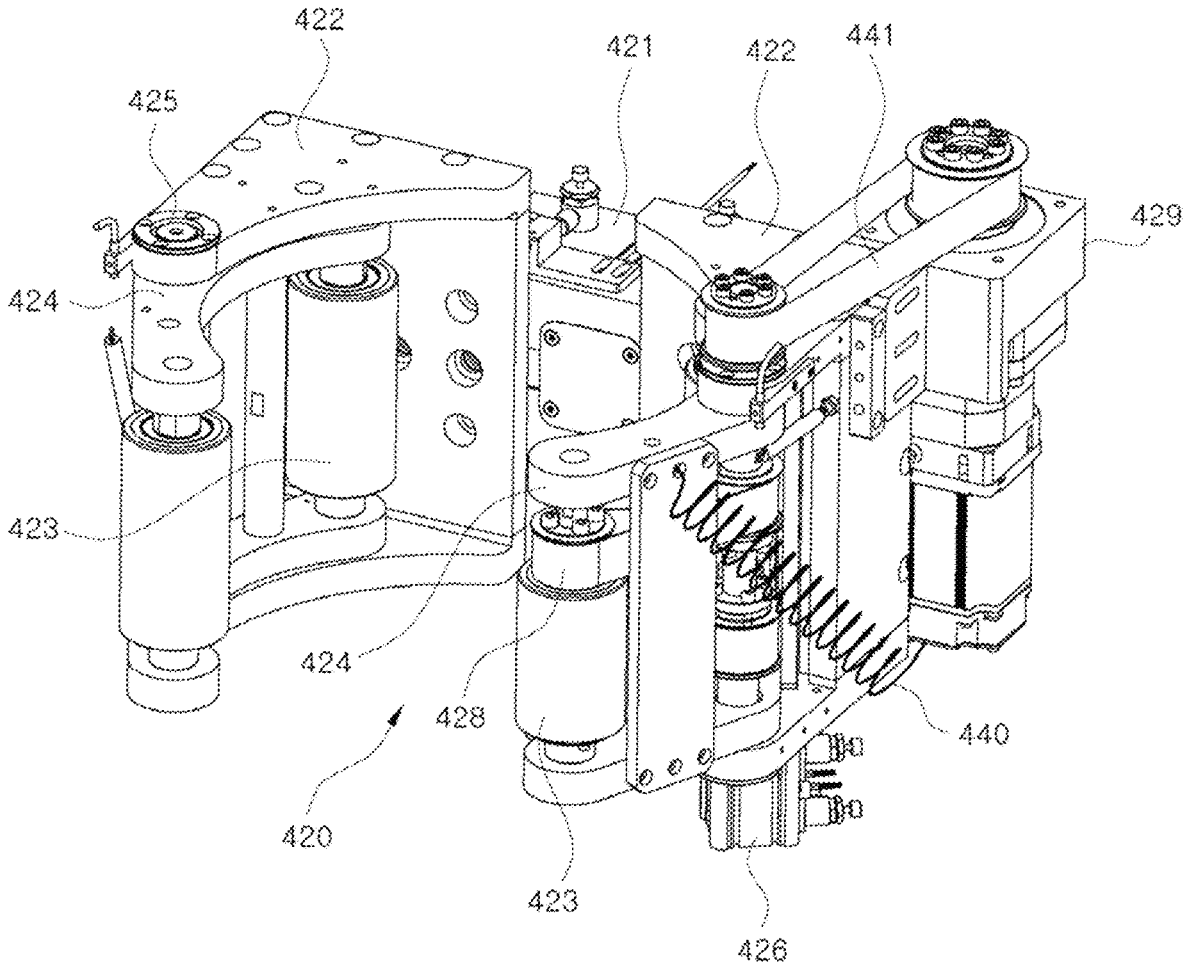
FIG. 5 is a perspective view showing a lower clamp according to the present invention.
Figure 6:
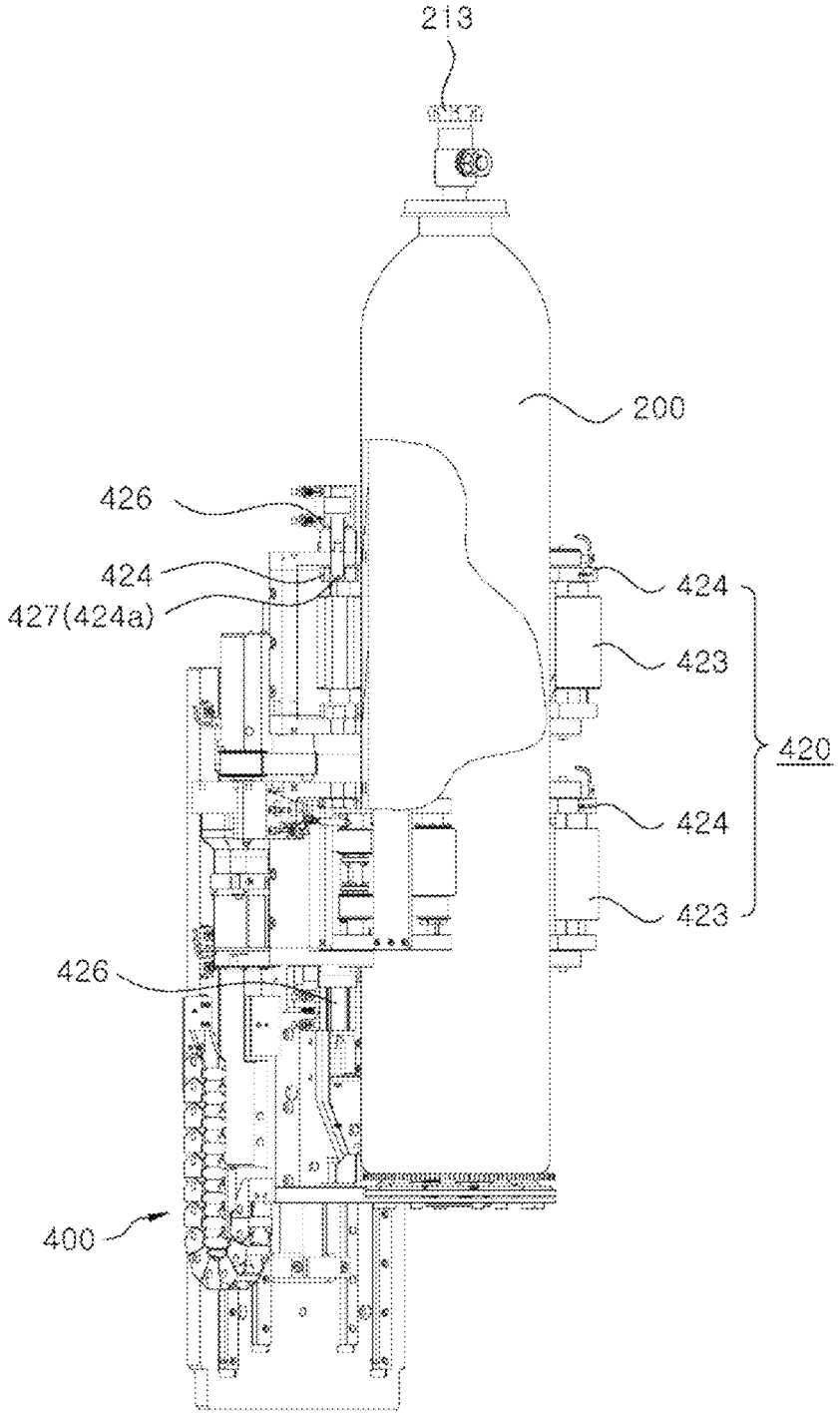
FIG. 6 shows a state in which a clamp is turned on while a high-pressure gas barrel is clamped by the clamp in the present invention.
Figure 7:
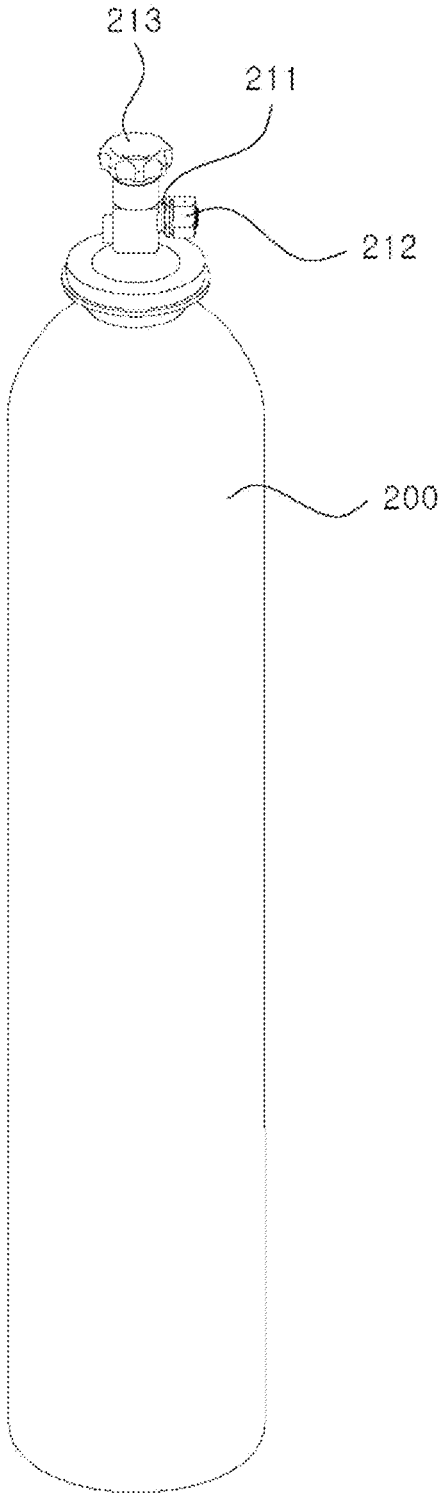
FIG. 7 is a perspective view showing a high-pressure gas barrel.

FIG. 5 is a perspective view showing the lower clamp. Referring to FIG. 5, the clamp 420 is installed such that the frames 422 are opened or closed simultaneously by the driving of a first actuator 421 and each of the frames 422 has a gripper 424 provided with two rollers 423 and installed so as to rotate around a shaft 425. In addition, a second actuator 426 is installed at the upper or lower portion of the frame 422 so as to raise and lower a stopper 427 into or from a positioning hole 424*a* formed in the gripper 424, as shown in FIG. 6, thereby preventing the pair of grippers 424 from opening while clamping the high-pressure gas barrel 200 loaded on the die 410, as shown in FIG. 6, a second actuator 426 is installed. Therefore, if the stopper 427 is inserted into the positioning hole 424*a* while the high-pressure gas barrel 200 is loaded on the die 410, even if the position of the high-pressure gas barrel 200 loaded on the die 410 is out of position, when the pair of frames 422 are retracted inwards by the first actuator 421, the pair of grippers 424 do not open and clamp the high-pressure gas barrel 200 since the stopper 427 is inside the positioning hole 424*a*.

Therefore, before clamping or unclamping the high-pressure gas barrel 200, the second actuator 421 must be driven to turn the stopper 427 on or off.

The one pair of rollers 423 rotatably installed on the gripper 424 are connected through a timing belt 428 and when a driving means 429 is driven, the power of the driving means 429 is transmitted through another timing belt 441. Therefore, there is provided a structure, in which when the rollers 423 at one side rotate, the one pair of rollers 423 installed on the gripper 424 positioned at the opposite side rotate even with no driving means since the rollers 423 are in close contact with the high-pressure gas barrel 200.

Before the high-pressure gas barrel 200 is loaded on the die 410, the one pair of grippers 424 can be maintained open while the first actuator 421 opens the one pair of frames 422, as shown in FIG. 5, since a coil spring 440 is connected between the frame 422 and the gripper 424 constituting the clamp 420.

Figure 9A:
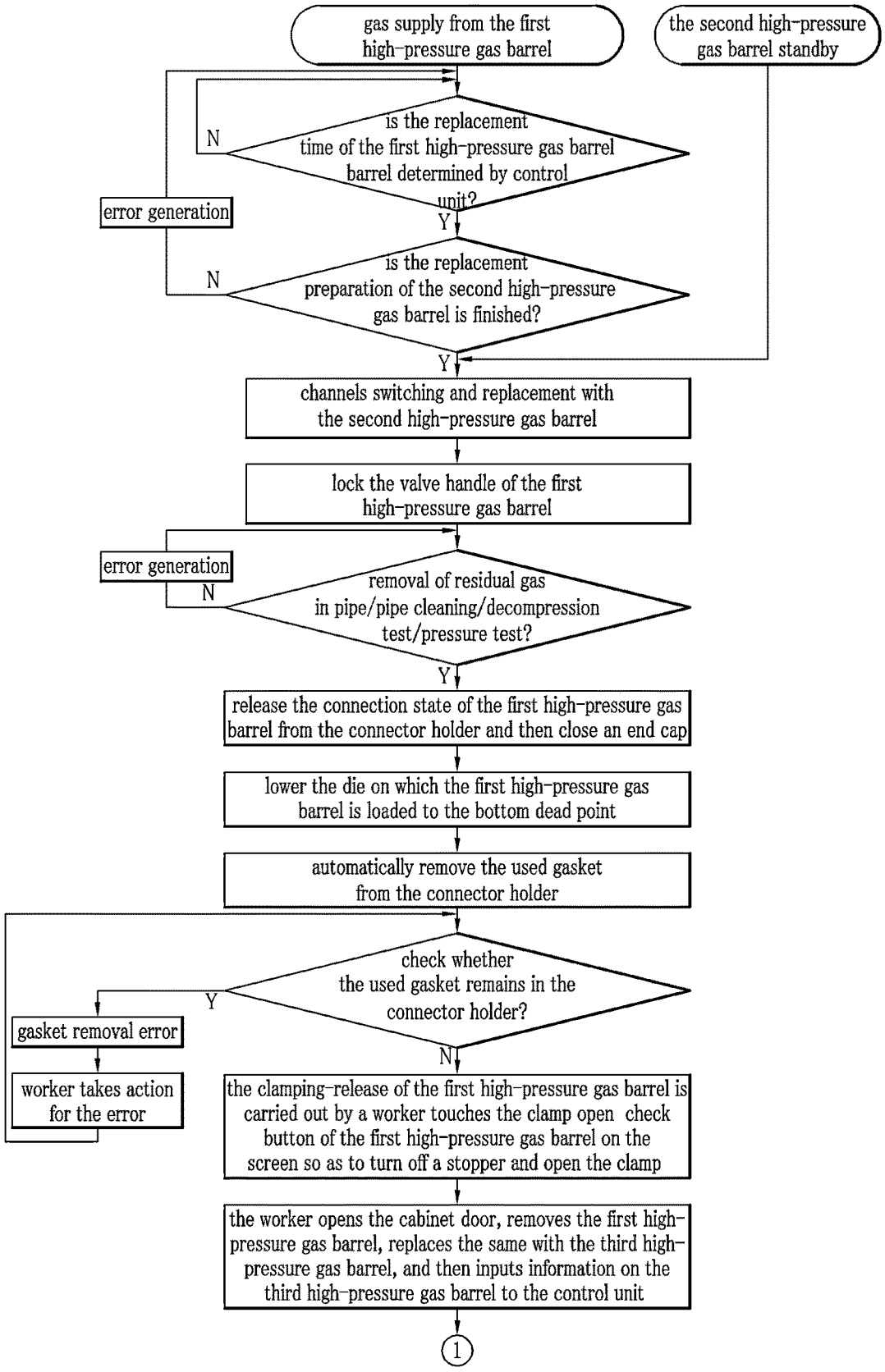
FIG. 9A and FIG. 9B are flowcharts for explaining the present invention.
Figure 9B:
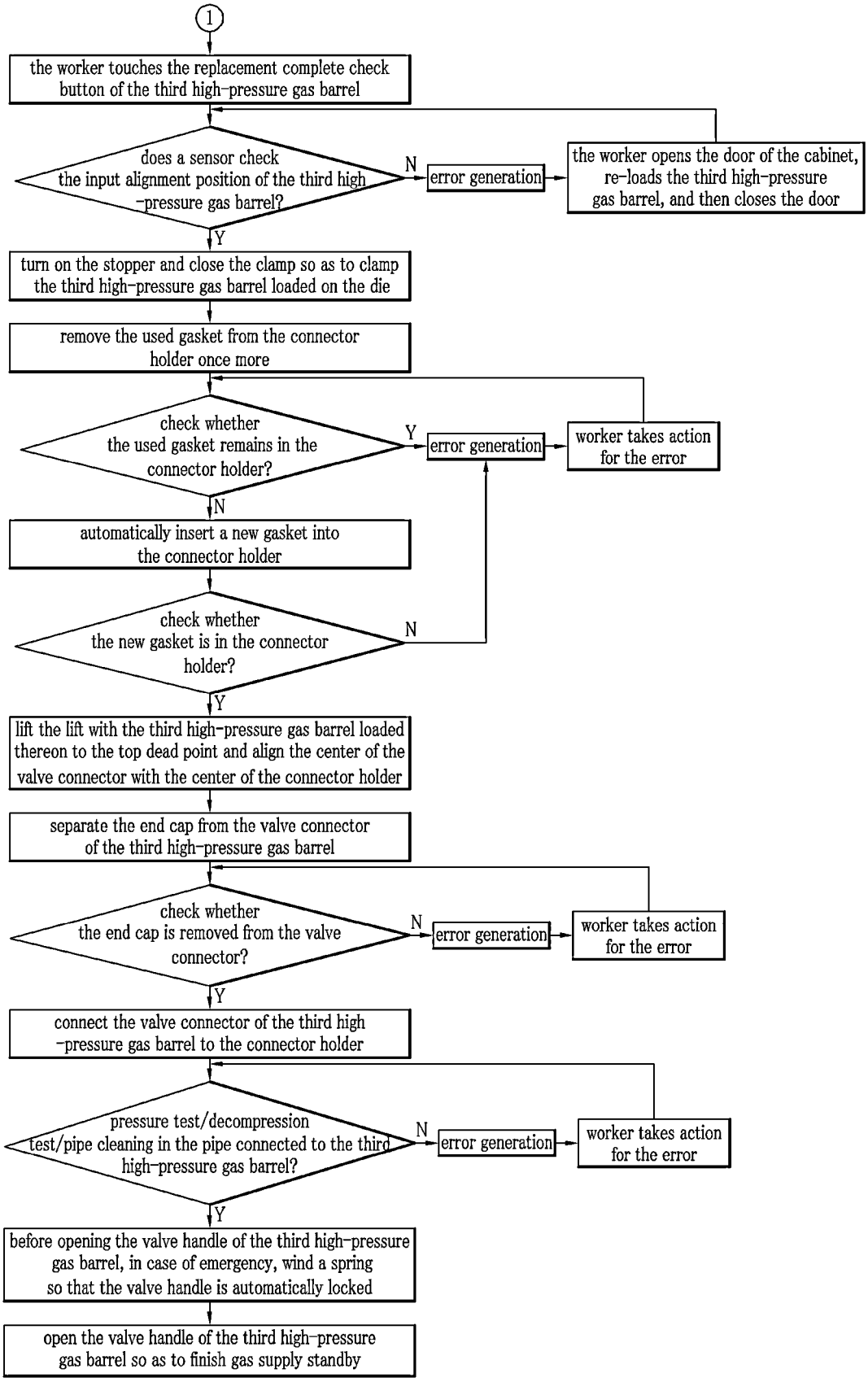

FIG. 9A and FIG. 9B are flowcharts for explaining the present invention. Referring to FIG. 9*a* and FIG. 9*b*, the present invention will be explained from a first step, wherein the first and second high-pressure gas barrels 201, 202 are initially loaded on the one pair of lifts 400, which are installed on the cabinet 100 so as to be lifted or lowered, so that the gas of the first high-pressure gas barrel 201 is supplied through the gas supply line and the second high-pressure gas barrel 202 is connected to the connector holder 310 in a standby state, as shown in FIG. 2.

If the replacement time of the first high-pressure gas barrel 201 is detected by a control unit 500 while supplying gas from the first high-pressure gas barrel 201 as described above, a second step is carried out by the control unit 500 for determining whether the replacement preparation of the second high-pressure gas barrel 202 is finished and, if finished, switching the channels of a gas pipe so as to stop gas supply from the first high-pressure gas barrel 201 and supplying gas from the second high-pressure gas barrel 202.

The reason why the control unit 500 determines this before replacing the second high-pressure gas barrel 202 is to switch the channels when it is determined to be normal while generating an error when it is determined to be abnormal by determining whether there is the second high-pressure gas barrel 202 or the valve connector 211 of the second high-pressure gas barrel 202 is correctly connected to the connector holder 310, wherein a worker must take actions while continuing to supply gas from the first high-pressure gas barrel 201 at the same time as an error is generated.

This is a measure to prevent defects from occurring in the wafer during the process due to the temporary stoppage of gas supply through the gas supply line.

Since the type of gas supplied varies depending on the processing process, the control unit 500 detects the weight or pressure of the first high-pressure gas barrel 201 and the replacement time of the first high-pressure gas barrel 201 is determined when the detected weight or pressure of the first high-pressure gas barrel 201 is equal to or less than a set value.

After switching the channels of the gas pipe and stopping the supply of gas from the first high-pressure gas barrel 201 as described above, the third step of automatically closing the valve handle 213 of the first high-pressure gas barrel 201 is performed.

The operation of automatically closing or opening the valve handle 213 of the first high-pressure gas barrel 201 is performed by the valve handle holder 610 of a valve handle unit 600, but since the constituent elements may be applied in various forms by experts in the field, the detailed description thereof will be omitted.

After the valve handle 213 of the first high-pressure gas barrel 201 is closed, gas remaining in the pipe, to which the first high-pressure gas barrel 201 is connected, is removed, cleaning of the inside of the pipe is carried out, and then a decompression test and a pressure test are performed. If it is determined to be normal as a result of the tests, the connection state of the first high-pressure gas barrel 201 is released from the connector holder 310 and then the valve connector 211 is automatically closed by the end cap 212 in a fourth step. If it is determined to be abnormal, an error is generated so that a worker may take action.

The operation of automatically closing or disconnecting the end cap 212 with respect to the valve connector 211 of the high-pressure gas barrel 200 is performed by the end cap holder 320 of the connection unit 300, but since this can also be applied in various forms by experts in the field, the detailed description thereof will be omitted.

Figure 8:
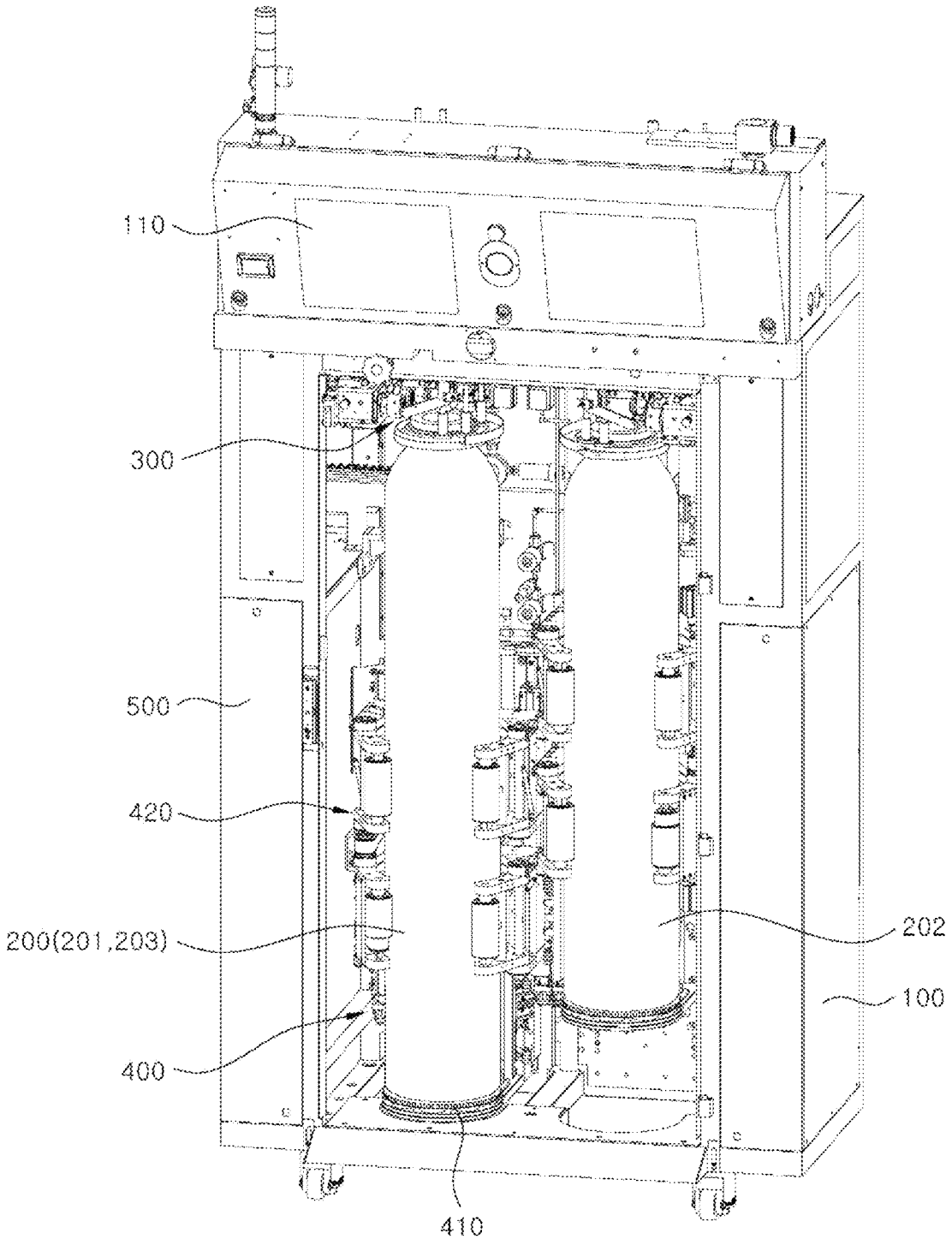
FIG. 8 shows a state, in which a lift for raising or lowering a first high-pressure gas barrel is positioned at a bottom dead point and a lift where a second high-pressure gas barrel is placed on a die is positioned at a top dead point, in the present invention.

After the end cap 212 of the first high-pressure gas barrel 201 is closed, the lift 400 is lowered to the bottom dead point as shown in FIG. 8 in order to replace the first high-pressure gas barrel 201 with a new third high-pressure gas barrel 203 in a fifth step.

In the step for lowering the lift 400 to the bottom dead point, a sixth step is carried out for automatically removing a gasket that has been used from the connector holder 310 by means of a gasket automatic removing means 700.

As for the time to automatically remove the used gasket from the connector holder 310, the used gasket removal may be performed after the lift 400 reaches the bottom dead point. However, since the used gasket is removed by additional driving other than the driving of the lift 400, it is possible to carry out the used gasket removal in the middle of lowering the lift 400 and thus the time to automatically remove the used gasket from the connector holder 310 is not necessarily limited.

After the used gasket is removed from the connector holder 310, it is checked whether the gasket remains in the connector holder 310 by using a sensor (not shown) so that if the gasket remains, an error is generated so as to allow a worker to take action. If there is no gasket remaining, a seventh step is performed to semi-automatically release the clamping state of the first high-pressure gas barrel 201 loaded on the die 410.

In the operation of releasing the clamping of the first high-pressure gas barrel 201, when the worker touches the clamp open check button of the corresponding screen 110 positioned at the upper portion of the cabinet 100, the second actuator 426 is driven to turn off the stopper 427 which is inserted into the positioning hole 424*a* of the gripper 424 and at the same time the first actuator 421 is driven so that the pair of frames 422 are spread to both sides, thereby releasing the clamping state of the first high-pressure gas barrel 201.

In the state, where the pair of frames 422 are opened by driving the first actuator 421 as described above, the grippers 424 maintain the opened state due to the restoring force of the coil spring 440.

After the clamping state of the first high-pressure gas barrel 201 is released in the operation as described above, an eighth step is carried out so that the worker opens the door of the cabinet 100, remove the first high-pressure gas barrel 201 from the die 410, loads the third high-pressure gas barrel 203 that is a new high-pressure gas barrel on the die 410, and then closing the door.

If the replacement of the high-pressure gas barrels is completed by loading the third high-pressure gas barrel 203 on the die 410, the worker touches the screen 110 so as to input the gas type, barcode, and weight of the new third high-pressure gas barrel 203 as the information on the third high-pressure gas barrel 203, closes the door of the cabinet 100, and then touches a button confirming that the replacement of the high-pressure gas barrels is completed.

After removing the first high-pressure gas barrel 201 from the die 410 and replacing it with a new third high-pressure gas barrel 203 at the same time in the above-mentioned operation, it is checked by using a sensor (not shown) whether the input alignment position of the third high-pressure gas barrel 203 newly loaded on the die 410 is correct. If the input alignment position is normal, a next step is carried out and if the input alignment position is shifted or abnormal, an error is generated so that the worker opens the closed door, removes the third high-pressure gas barrel 203 from the die 410, re-loads the third high-pressure gas barrel 203, and then closes the door.

Therefore, if the input alignment position of the third high-pressure gas barrel 203 loaded on the die 410 is normal, the ninth step of clamping the third high-pressure gas barrel 203 loaded on the die 410 is performed.

The clamping of the third high-pressure gas barrel 203 is carried out contrary to the unclamping of the high-pressure gas barrel.

That is, when the worker pushes the third high-pressure gas barrel 203 so that the third high-pressure gas barrel 203 is loaded on the die 410, the rollers 423 positioned inside are pushed inwards by the third high-pressure gas barrel 203 so that the one pair of grippers 424 that are mutually opened by the restoring force of the coil spring 440 simultaneously close and the rollers 423 rotatably installed in the gripper 424 simultaneously encompass the third high-pressure gas barrel 203.

In this way, if the worker touches the clamp close check button of the screen 110 in the state where the rollers 423 encompass the third high-pressure gas barrel 203, the second actuator 426 is driven so as to turn the stopper 427 on and thus to insert the stopper 427 into the positioning hole 424*a* of the gripper 424 and at the same time the first actuator 421 is driven so as to close the one pair of frames 422 inwards so that the rollers 423 complete the clamping of the third high-pressure gas barrel 203.

After the clamping of the third high-pressure gas barrel 203 loaded on the die 410 is finished, a new gasket has to be automatically inserted into the connector holder 310, to which the third high-pressure gas barrel 203 is connected, wherein it is preferable to check whether any used gasket remains in the connector holder 310 before inserting a new gasket.

However, it is more preferable to perform the operation of removing the used gasket from the connector holder 310 before checking the used gasket once again, and then check whether there is a residual gasket.

If there is a residual gasket in the connector holder 310, an error is generated by the control unit 500 so that the worker can take action.

Checking whether the used gasket remains in the connector holder 310 several times in this way is to fundamentally block the phenomenon of harmful gas leakage due to the connection failure caused by the existence of such a residual gasket when connecting the valve connector 211 of the third high-pressure gas barrel 203 to the connector holder 310.

As described above, when it is confirmed that no used gasket is present in the connector holder 310, a tenth step is performed to automatically insert a new gasket into the connector holder 310 by the gasket automatic removing means 700.

After automatically inserting a new gasket into the connector holder 310, a step of confirming whether the new gasket is inserted into the connector holder 310 by means of a sensor (not shown) is further performed.

This is to essentially eliminate the leakage of harmful gas caused when connecting the valve connector 211 of the third high-pressure gas barrel 203 to the connector holder 310 without inserting a new gasket into the connector holder 310.

If it is confirmed by the control unit 500 that the new gasket is inserted into the connector holder 310, an eleventh step is carried out to lift the lift 400 with the third high-pressure gas barrel 203 loaded thereon to the top dead point and align the center of the valve connector 211 with the center of the connector holder 310.

The operation of aligning the center of the valve connector 211 with the center of the connector holder 310 as described above is carried out by matching the center of the end cap 212 of the valve coupled to the third high-pressure gas barrel 203 to the center of the connector holder 310 connected to the gas pipe while automatically raising, lowering, and rotating the third high-pressure gas barrel 203 loaded on the lift 400.

After matching the center of the end cap 212 coupled to the third high-pressure gas barrel 203 to the center of the connector holder 310 connected to the gas pipe, a twelfth step is carried out by removing the end cap 212 from the third high-pressure gas barrel 203 by using the end cap holder 320 of the connection unit 300 and connecting the valve connector 211 to the connector holder 310.

It is more preferable to further perform an operation of winding a spring around the shaft (not shown) of the valve handle unit 600 so that the valve handle 213 is automatically locked in case of emergency, before opening the valve handle 213 of the third high-pressure gas barrel 203 after removing the end cap 212 from the third high-pressure gas barrel 203 and connecting the valve connector 211 to the connector holder 310.

This is to make it possible to fundamentally solve the phenomenon that a safety accident occurs due to gas leakage by automatically locking the valve handle 213 of the third high-pressure gas barrel 203 when gas leaks or power outages occur due to sudden vibrations or earthquakes in the process of supplying gas from the third high-pressure gas barrel 203 to the gas supply line through the gas pipe.

After winding the spring (not shown) around the shaft of the valve handle unit 600 so that the valve handle 213 of the third high-pressure gas barrel 203 is locked, a thirteenth step is carried out to rotate the valve handle holder 610 of the valve handle unit 600 and open the valve handle 213 of the third high-pressure gas barrel 200 in a standby state.

After opening the valve handle 213 of the third high-pressure gas barrel 203, it is more preferable to further perform a decompression test and a pressurization test in the pipe.

According to an embodiment of the present invention, two high-pressure gas barrels 200 are loaded in the cabinet 100 and the high-pressure gas barrel 200 is automatically replaced when the gas in the high-pressure gas barrel 200 is equal to or less than a set value, but it would be understood that three to four or more high-pressure gas barrels 200 may be loaded in the cabinet 100 and sequentially replaced whenever the replacement time of the high-pressure gas barrel 200 is detected by the control unit 500.

While the present invention has been particularly shown and described with reference to the preferred embodiments thereof, it will be understood by those skilled in the art that various changes in form and details may be made therein without departing from the spirit and scope of the invention as defined by the appended claims.

Therefore, the above-described embodiments are to be considered in all respects as illustrative and not restrictive, and the scope of the invention as set forth in the foregoing detailed description is indicated by the following claims, and all such modifications or variations that come within the meaning and range of the claims and their equivalents are intended to be embraced therein.

What is claimed is:

1. A method for automatically replacing high-pressure gas barrels, comprising in sequence:

the first step of loading first and second high-pressure gas barrels on one pair of lifts, which are installed on a cabinet so as to be lifted or lowered, so as to supply a first gas of the first high-pressure gas barrel through a gas supply line and connecting a valve connector of the second high-pressure gas barrel to a connector holder in a standby state;

the second step of switching channels so as to stop a supply of the first gas from the first high-pressure gas barrel and supplying a second gas from the second high-pressure gas barrel, if a replacement time of the first high-pressure gas barrel is detected by a control unit while supplying the first gas from the first high-pressure gas barrel;

the third step of automatically closing a valve handle of the first high-pressure gas barrel;

the fourth step of releasing a connection state of the first high-pressure gas barrel from the connector holder and closing the valve connector by an end cap of the first high-pressure gas barrel;

the fifth step of lowering a die, on which the first high-pressure gas barrel is loaded, to a bottom dead point;

the sixth step of automatically removing a used gasket that has been used for the first high-pressure gas barrel from the connector holder;

the seventh step of releasing a clamping state of the first high-pressure gas barrel loaded on the die;

the eighth step of opening a door of the cabinet and removing the first high-pressure gas barrel from the die, and then loading a third high-pressure gas barrel on the die and closing the door;

the ninth step of clamping the third high-pressure gas barrel loaded on the die;

the tenth step of automatically inserting a new gasket for the third high-pressure gas barrel into the connector holder;

the eleventh step of lifting the lift, on which the third high-pressure gas barrel is loaded, to a top dead point and then aligning a center of the valve connector and a center of the connector holder;

the twelfth step of removing an end cap of the third high-pressure gas barrel from the third high-pressure gas barrel and then connecting the valve connector to the connector holder; and the thirteenth step of opening a valve handle of the third high-pressure gas barrel in a standby state.

2. The method for automatically replacing high-pressure gas barrels according to claim 1, wherein the replacement time of the first high-pressure gas barrel is determined when the control unit detects a weight or pressure of the first high-pressure gas barrel and the detected weight or pressure of the first high-pressure gas barrel is less than or equal to a set value.

3. The method for automatically replacing high-pressure gas barrels according to claim 1, wherein opening and closing of the valve handle of the first high-pressure gas is carried out by a rotation of a valve handle holder constituting a valve handle unit.

4. The method for automatically replacing high-pressure gas barrels according to claim 1, wherein the end cap of the first high-pressure gas barrel is locked on or separated from the valve connector of the first high-pressure gas barrel by an end cap holder of a connection unit.

5. The method for automatically replacing high-pressure gas barrels according to claim 1, wherein the automatically removing the used gasket used for the first high-pressure gas barrel from the connector holder in the sixth step is carried out at the time when the die reaches the bottom dead point.

6. The method for automatically replacing high-pressure gas barrels according to claim 5, further comprising the step of checking an existence of the used gasket used for the first high-pressure gas barrel at the connector holder after removing the used gasket that has been used for the first high-pressure gas barrel from the connector holder.

7. The method for automatically replacing high-pressure gas barrels according to claim 6, wherein if the used gasket used for the first high-pressure gas barrel is detected in the step of the checking the existence of the used gasket, an error is generated by a control unit so that a worker takes an action for the error.

8. The method for automatically replacing high-pressure gas barrels according to claim 1, further comprising the step of determining whether the third high-pressure gas barrel loaded on the die in the eighth step is in position.

9. The method for automatically replacing high-pressure gas barrels according to claim 1, further comprising the step of checking whether the used gasket used for the first high-pressure gas barrel remains in the connector holder before inserting the new gasket for the third high-pressure gas barrel into the connector holder.

10. The method for automatically replacing high-pressure gas barrels according to claim 9, further comprising the step of removing the used gasket used for the first high-pressure gas barrel from the connector holder once more before the checking whether the used gasket used for the first high-pressure gas barrel remains in the connector holder.

11. The method for automatically replacing high-pressure gas barrels according to claim 1, further comprising the step of checking whether the new gasket for the third high-pressure gas barrel has been inserted in the connector holder after the tenth step.

12. The method for automatically replacing high-pressure gas barrels of claim 9, wherein if the used gasket used for the first high-pressure gas barrel is detected in the step of the checking whether the used gasket used for the first high-pressure gas barrel remains in the connector holder, an error is generated by a control unit so that a worker takes an action for the error.

13. The method for automatically replacing high-pressure gas barrels according to claim 1, wherein the releasing the clamping state of the first high-pressure gas barrel in the seventh step is carried out by a worker by pressing a clamp open check button so as to turn off a stopper and open a clamp.

14. The method for automatically replacing high-pressure gas barrels according to claim 1, wherein the clamping the third high-pressure gas barrel is carried out by a worker by pressing a clamp close check button so as to turn on the stopper and closing a clamp.

15. The method for automatically replacing high-pressure gas barrels according to claim 1, further comprising the step of carrying out a decompression test and a pressing test in a pipe after the valve handle of the third high-pressure gas barrel is opened.

16. The method for automatically replacing high-pressure gas barrels according to claim 15, further comprising the step of winding a spring on a shaft of a valve handle holder constituting a valve handle unit so that the valve handle is automatically closed in an emergency state, before opening the valve handle of the third high-pressure gas barrel.

* * * * *